US005136625A

United States Patent [19]

Heiting et al.

[11] Patent Number: 5,136,625

[45] Date of Patent: Aug. 4, 1992

[54] METAL CENTER X-RAY TUBE

[75] Inventors: Robert F. Heiting; Robert C. Treseder, both of Salt Lake City; Brian D. Green, Sandy, all of Utah

[73] Assignee: Varian Associates, Inc., Palo Alto, Calif.

[21] Appl. No.: 780,694

[22] Filed: Oct. 18, 1991

[51] Int. Cl.[5] ..... H01J 35/10

[52] U.S. Cl. ..... 378/139; 378/119; 378/125; 378/142

[58] Field of Search ..... 378/119, 121, 123, 125, 378/142, 139, 140, 144, 145

[56] References Cited

U.S. PATENT DOCUMENTS 2,703,373 6/1949 Cummings ..... 378/139

4,468,802 8/1984 Friedel ..... 378/125

*Primary Examiner*—Janice A. Howell
*Assistant Examiner*—Don Wong
*Attorney, Agent, or Firm*—Sheri M. Novack

[57] ABSTRACT

An improved metal center rotating anode x-ray tube is shown. The improved x-ray tube includes means for preventing the build-up of charge on the anode glass portion of the tube envelope where the glass flares by constraining the equipotential lines of the electric field in the vicinity of th eflare to parallel the flare surface. Parallelism may be achieved by (1) controlling the angle of the flare and sealing the flare directly to the metal section, (2) modifying the anode rotor to include a flare conforming to the glass flare, and (3) including a ground plane screen in the tube housing.

5 Claims, 5 Drawing Sheets

METAL CENTER X-RAY TUBE

FIELD OF THE INVENTION

The present invention relates to x-ray tubes and, in particular, to diagnostic, rotating anode x-ray tubes having an envelope comprising a metal center section.

BACKGROUND OF THE INVENTION

Rotating anode x-ray tubes are well-known and have been used in medical diagnostic applications for several decades. Originally, rotating anode tubes consisted of an internal tube structure housed in a glass vacuum envelope. More recently, a new category of rotating anode x-ray tube has become available wherein the major portion of the vacuum envelope of the tube is made of metal. So called "metal center" x-ray tubes have the primary advantage of being able to withstand higher power levels, such as those used in modern CT scanning applications.

In a metal center tube, the metal portion surrounds the target portion of the rotating anode and the active, electron-beam producing portion of the cathode structure. Primarily for safety reasons, the metal center section is held at ground potential, whereas both the cathode and anode are held at very high voltages during operation. For example, in a typical rotating anode x-ray tube, whether all glass or metal center, the anode may be held at +75,000 volts and the cathode at −75,000 volts to create a potential difference of 150,000 volts between the electrodes of the tube. (This large potential difference is necessary to impart enough energy to the electron beam that when the electrons strike the anode they have sufficient energy to produce useable x-rays.) In view of these voltage relationships, it is necessary to insulate the grounded metal center section from both the anode and the cathode of the tube.

The insulation of the metal center section is typically accomplished by using glass support cylinders, one for the anode end of the tube and one for the cathode end; although it is also known to use ceramic as an insulator instead of glass. However, the use of ceramic insulating end pieces has been limited to the cathode end of the tube in commercial applications. The insulating end pieces are hermetically sealed to each end of the metal center structure to provide a vacuum tight envelope having electrical isolation between the cathode, metal center structure and the anode.

A major disadvantage of metal center x-ray tubes, not present in glass envelope tubes, has been an electrical weakness in the anode glass region. A frequent cause of failure of metal center tubes is due to electrical discharges where the anode glass flares away from the rotor, (i.e., in the area of curved glass section 83 in FIG. 1). Despite the development of improved parts processing, vacuum firing, tube exhaust and tube aging techniques to avoid this problem, the inherent electrical weakness in this region continues to be a major cause of tube failure, and is becoming a limiting factor in developing even higher power tubes.

Accordingly, an object of the present invention is to provide an improved metal center tube capable of operating at higher power levels.

Another object of the present invention is to reduce the electrical weakness in the anode region of the envelope of metal center x-ray tubes.

SUMMARY OF THE INVENTION

The above objects, along with others that will be apparent to those skilled in the art, are accomplished by the present invention which comprises means for controlling the electric field in the vicinity of the anode glass section. In particular, a structural design is implemented to improve the relationship between the equipotential lines of the electric field between the anode and the anode glass with the surface of the glass, whereby the equipotential lines are more nearly parallel to the inner surface of the anode glass, thereby reducing the likelihood of electron migration along the inner surface of the glass. The structural design of a preferred embodiment comprises an anode glass section having a cylindrical portion and a flared portion which is sealed to the metal, center section at the angle of the cone, and a contoured rotor structure. A ground plane screen may also be used to influence the configuration of the electric field.

DETAILED DESCRIPTION OF A PREFERRED EMBODIMENT

Figure 1:
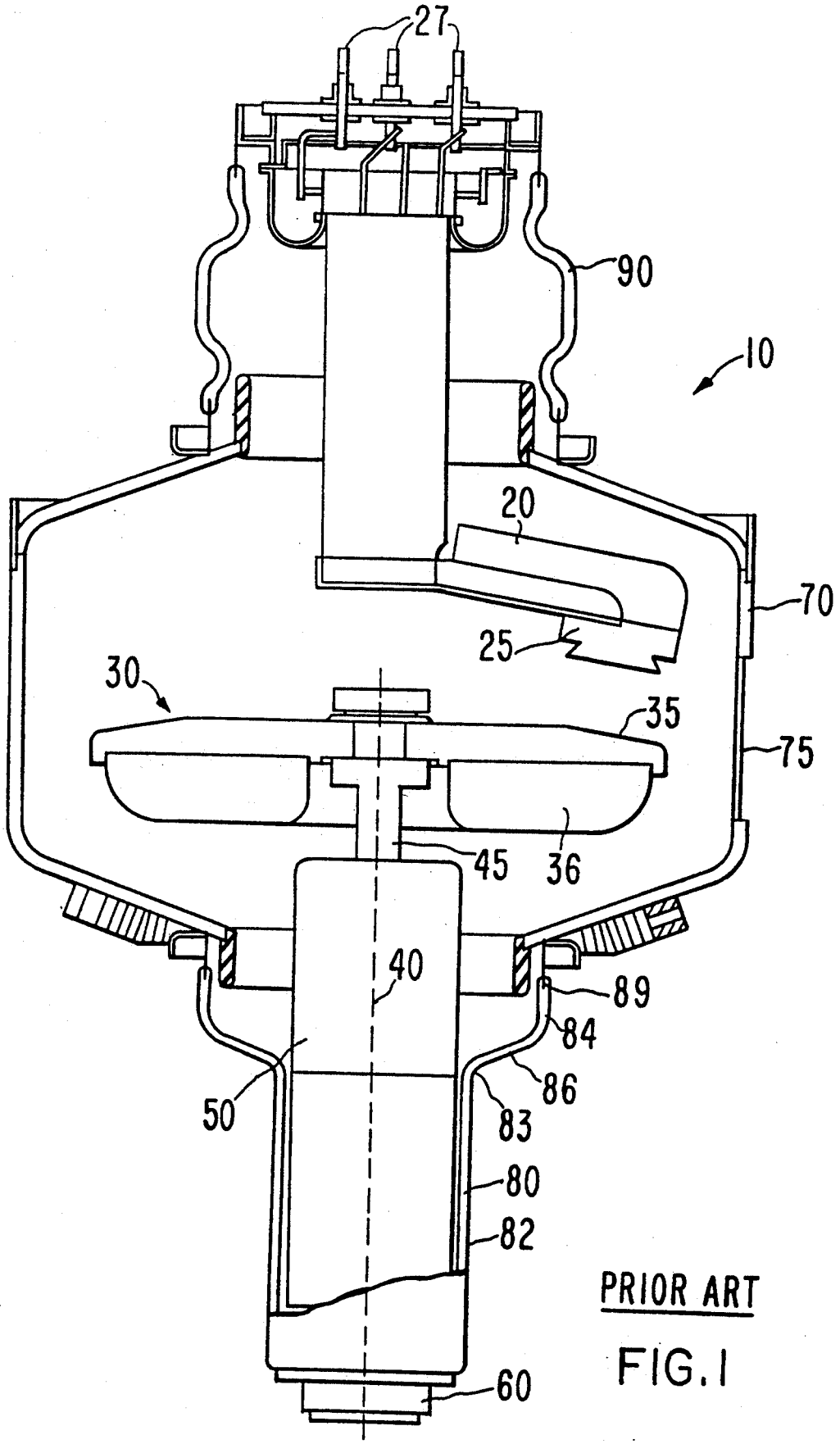
PRIOR ART FIG. 1
FIG. 1 is a cross-sectional view of a metal center rotating anode x-ray tube of the prior art.

A cross-section of a typical rotating anode metal center x-ray tube 10 of the type known in the prior art is shown in FIG. 1. As is well known to those skilled in the art, x-ray tube 10 comprises a cathode structure 20 including a cathode head 25 containing one or more thermionic filaments (not shown) from which electrons are emitted. In a typical tube, the cathode structure 20 is held at a very high negative potential in relation to ground, for example, −75,000 volts. Electrical connection to the cathode is made via feedthrough connectors 27, mounted at a cathode end of the tube, which provide the high operating voltage and one or more filament voltages.

An anode 30 is rotated about the central axis 40 of tube 10. Rotating anode 30 comprises an upper target track 35 made of a refractory material, such as tungsten, which emits x-rays of a suitable energy spectrum when struck by highly energetic electrons from the cathode. In a typical x-ray tube the anode is held at a very high positive potential in relation to ground, for example, +75,000 volts. Accordingly, electrons emitted from the cathode filament are accelerated across a very large potential gradient gaining considerable kinetic energy before striking the anode target track 35.

Creation of x-rays in this manner is a very inefficient process, with less than one percent of the electron energy typically being converted into usable x-ray energy. Most of the remaining energy is released as heat acquired by anode 30. Accordingly, anode 30 may have heat storage means 36, which may, for example, comprise a mass of graphite or other material with a high specific heat.

Rotating anode 30 is attached to a shaft 45 using conventional fastening means. Shaft 45 is, in turn, attached to motor rotor 50. Rotor 50 is attached internally to bearings mounted on a shaft attached to tube bottom 60. None of the internal to motor rotor 50 is shown, however, such structure is well-known to those skilled in the art. Electrical connection to the anode is made through tube bottom 60.

The vacuum envelope for the tube is formed, in part, by metal center portion 70, anode glass portion 80 and cathode glass portion 90. Metal center portion contains a window 75 adjacent the electron beam focal point on target track 35. Window 75 may be made of a material, such as beryllium, which is relatively transmissive to x-rays in comparison to the rest of metal center portion 70 which may be made of a material, such as copper, with good thermal properties. Cathode glass portion 90, generally opposite anode glass portion 80, electrically isolates feedthrough connectors 27 from the rest of the tube.

Commercial x-ray tubes, whether metal center or glass, are contained within a lead-lined housing which insures that x-rays can be emitted in only one direction, and which protects the user from the very high voltages employed. A cooling fluid, typically oil, is circulated within the housing to remove the heat generated by the tube. Such housings are well-known to those skilled in the art and will not be described in further detail, except to the extent necessary to understand the present invention. X-ray tubes, whether glass or metal center, are sometimes referred to as "inserts" because they can be replaceably inserted within x-ray tube housings.

In known prior art metal center x-ray tubes, the anode glass portion 80 consists of a cylindrical section 82 closely surrounding rotor 50, a second, larger diameter, cylindrical section 84, and a conical or flared section 86 interconnecting the two cylindrical sections. A curved section 83 connects flared section 86 with cylindrical section 82 surrounding rotor 50. In prior art metal center x-ray tubes, failure of the anode glass, a significant cause of tube malfunction, most commonly occurs in the vicinity of anode glass curved section 83.

Figure 2:
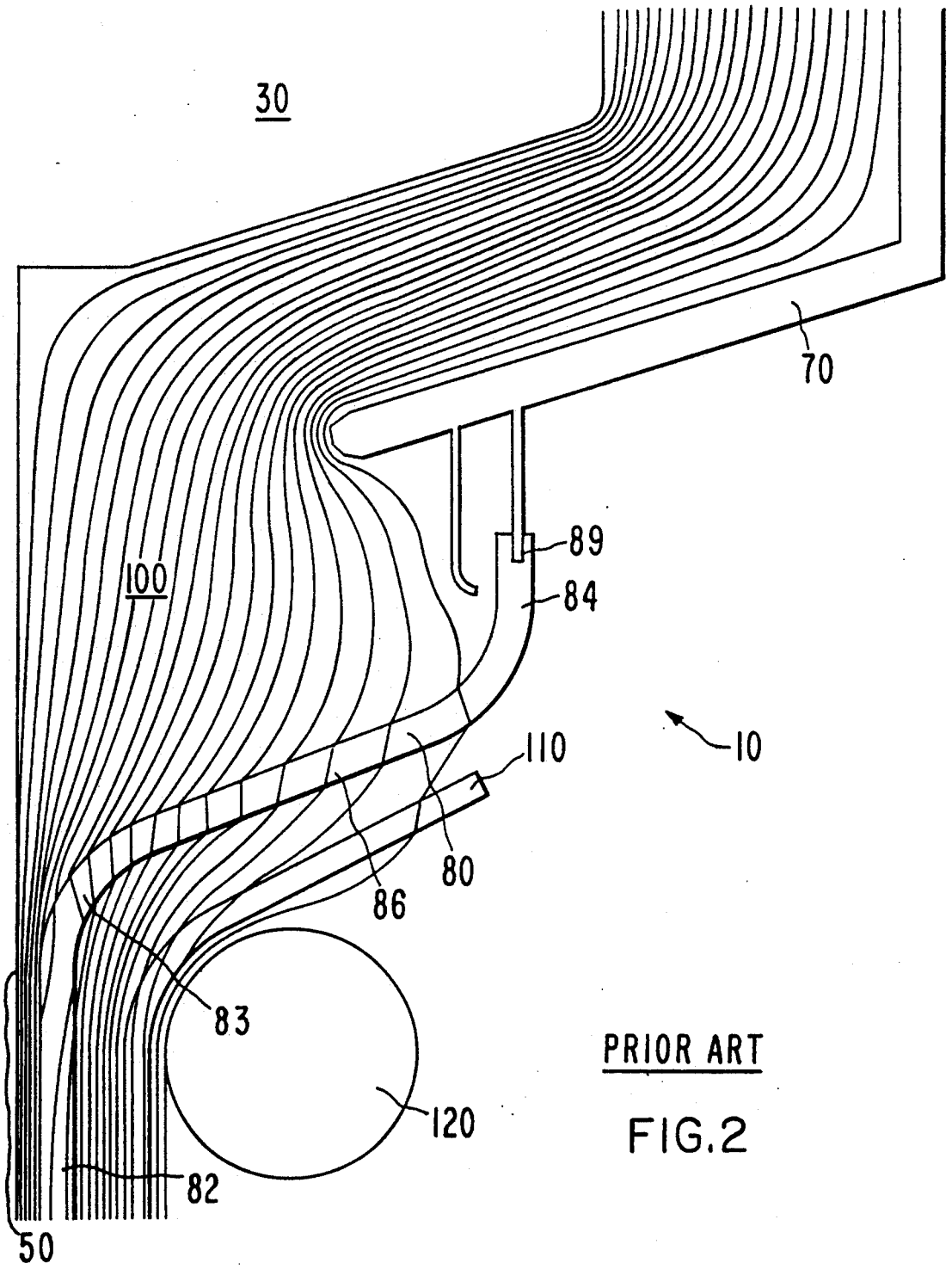
PRIOR ART FIG.2
FIG. 2 is partially schematic, cross-sectional view of the upper portion of the anode glass section of the prior art x-ray tube of FIG. 1 showing computed equipotential lines in the region between the anode and the tube envelope.

FIG. 2 is a partially schematic, cross-sectional view of prior art, metal center x-ray tube showing the area in the vicinity of the anode glass. As is shown more clearly in FIG. 2, a glass to metal seal 89 connects metal center portion 70 to the anode glass 80.

A computer model was utilized to generate equipotential lines 100 in the area extending from anode 30 to the outside of tube 10. Each equipotential line represents an equal change in the electric field potential from a neighboring line; the potential being greatest near the surface of anode 30, and minimal near the surface of metal center section 70 which is held at ground potential. For example, assuming that a voltage of +75,000 volts is placed on the anode, each line depicted in FIG. 2 represents a difference in potential of about 3600 volts from its neighbors.

Since metal center section 70 is held at ground potential none of the equipotential lines extend through it. However, the equipotential lines do extend through anode glass portion 80 as shown. The structure in the housing adjacent to anode glass 80 was included in the model because of its influence on the electric field. The structure shown includes a glass shield 110 and stator windings 120. Other housing structure, not shown, was also included in the model for purposes of calculating the equipotential lines.

Figure 3:
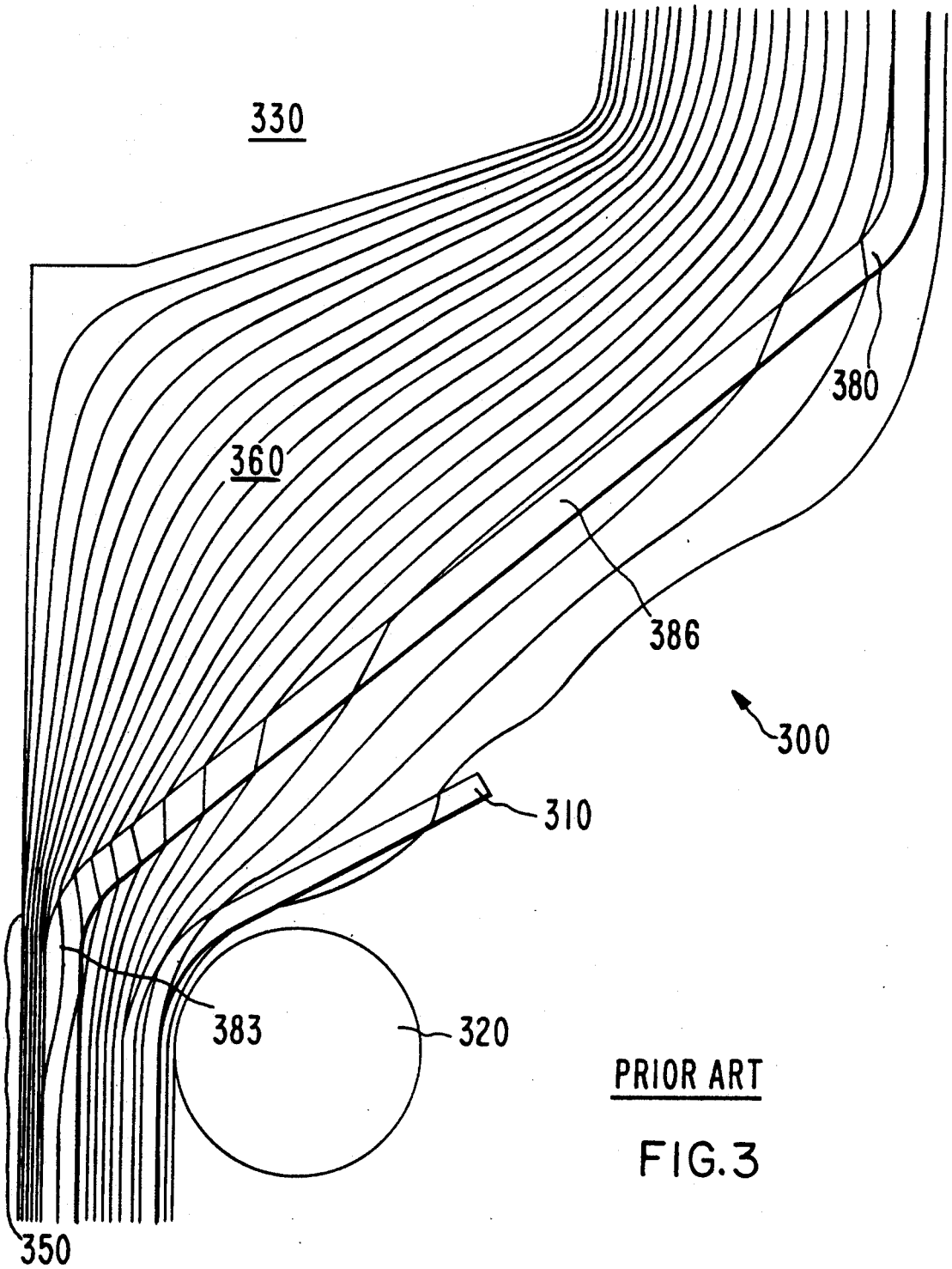
PRIOR ART FIG.3
FIG. 3 is partially schematic, cross-sectional view of a portion of a glass prior art x-ray tube showing computed equipotential lines in the region between the anode and the tube envelope.

For comparison, a similar computer model plot of the equipotential lines in a typical glass envelope tube was developed and is shown in FIG. 3. Glass x-ray tube 300 includes an anode 330 and a glass envelope 380. As in FIG. 2, outside the tube, within the housing, are glass shield 310 and stator windings 320.

A comparison of FIGS. 2 and 3 illustrates the difference between metal center and glass envelope tubes that make metal center tubes more susceptible to arcing and punctures in the region of the anode glass flare 83. In the glass envelope tube the equipotential lines 360 close to the inside surface of flare 386 are nearly parallel to the glass surface. In the metal center tube the equipotential lines intercept the inside flare surface at more of an angle.

The angle at which the equipotential lines intersect glass flare 86 in prior art metal center tubes creates forces on the electrons on the inside surface of glass flare 86 driving them towards curved portion 83 between the glass flare and the cylindrical glass portion 82 surrounding the rotor 50. When electrons arrive at the curved portion 83 the force along the glass surface disappears since the equipotential lines are parallel to the cylindrical portion 82 of anode glass 80. For these reasons, electrons collect in the region of curved portion 83. As electrons collect in this region, charge builds up until breakdown voltage is reached between the glass and rotor 50. At breakdown, electrons from the glass bombard the surface of the rotor 50, causing sputtering of heavy ions of the rotor material which, in turn, are attracted to and bombard the negatively charged glass surface. This chain of events can cause catastrophic tube failure due to puncturing of the glass.

As shown in FIG. 3, in glass envelope tubes electrons on the surface of the glass flare are subject to little force along the surface since the equipotential lines are nearly parallel to the surface. Thus, it is believed that there is little charge build-up in the vicinity curved portion 383 of glass envelope 380. A further complication with metal center tubes is that the metal section serves as an essentially limitless source of electrons which are free to migrate to the glass.

It is believed that the foregoing reasons for breakdown of the anode glass in metal center tubes were not previously recognized. The generally held belief among skilled artisans was that arcing and glass puncturing near curved portion 83 of the anode glass was due to the presence of the stator winding in this region. One of the original purposes of glass shield 110 was to mitigate the perceived problem caused by the electric field between the stator 320 and the rotor 350. Other past attempts to solve the problem include further lengthening the surface of the anode glass (e.g., by increasing the angle of the flare section relative to the tube axis) to provide increased insulation between the metal center section and the stator winding, and making a smaller flare to minimize wall charge. These "solutions" failed to recognize the cause of the problem and, therefore, did not substantially improve the ability of the anode glass to withstand breakdown.

Figure 4:
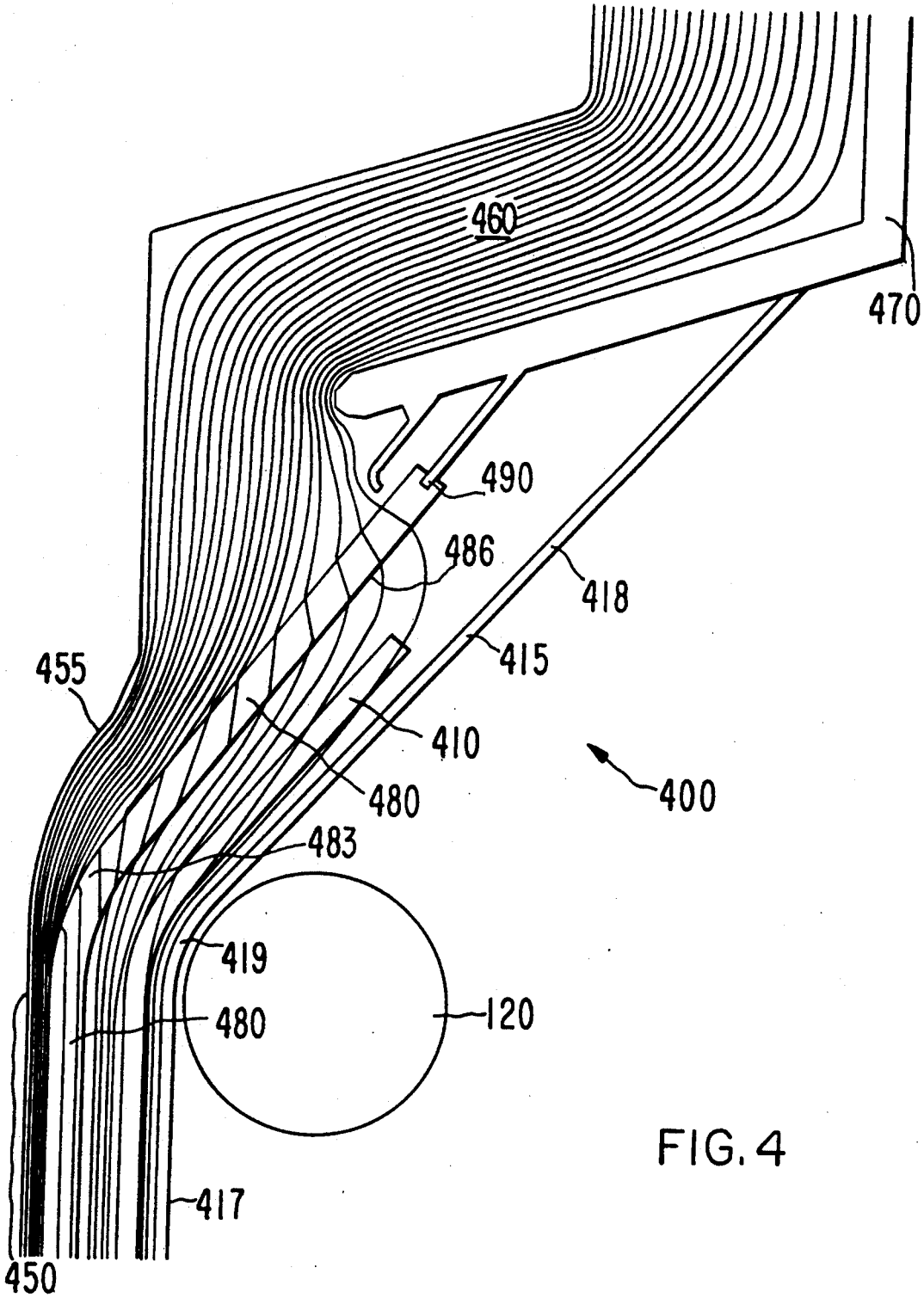
FIG. 4 is partially schematic, cross-sectional view of a portion of an x-ray tube made in accordance with a preferred embodiment of the present invention showing computed equipotential lines in the region between the anode and the tube envelope.
Figure 5:
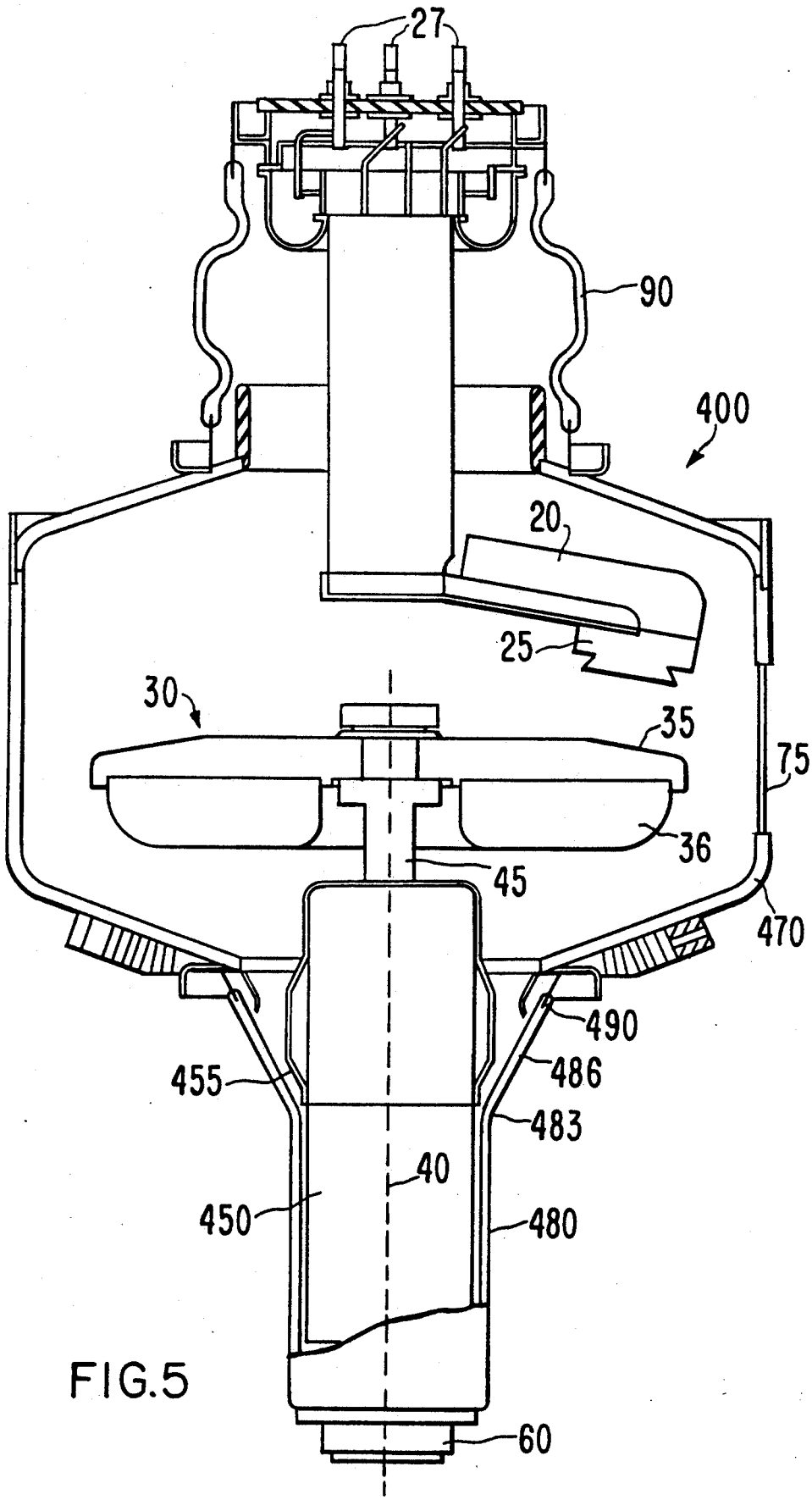
FIG. 5 is a cross-sectional view of a metal center rotating anode x-ray tube made in accordance with a preferred embodiment of the present invention.

In order to overcome the above-described problem, a new anode glass design, as shown in FIGS. 4 and 5, was developed wherein the equipotential lines are more nearly parallel to the inner surface of the flare portion of the anode glass. As parallelism is approached, the force on electrons along the surface of the anode glass flare is lessened. This, in turn, reduces the likelihood of charge migration along the surface of the glass flare towards the beginning of the flare, so that the risk of charge build-up and ensuing breakdown are substantially mitigated.

FIG. 4 shows a computer generated equipotential plot, similar to those shown in FIGS. 2 and 3, of a metal center rotating anode x-ray tube made in accordance with a preferred embodiment of the present invention. Referring to both FIGS. 4 and 5, x-ray tube 400 is, in many respects, the same as the tube shown in FIG. 1. Those elements of tube 400 that are unchanged are given the same numbers as the corresponding elements of tube 10 of FIG. 1, and the reader is referred to the discussion of FIG. 1 for a description of these elements. Likewise, stator winding 120 is substantially the same as is shown in FIG. 2.

The principal differences between the prior art design for metal center tubes and the design of a preferred embodiment of the present invention are shown most clearly in FIG. 4. A number of structural changes have been made to increase the parallelism of the equipotential lines.

First, the glass flare portion 486 of the anode glass 480 is sealed directly to the metal center section 470 of tube 400. Thus, the cylindrical portion 84 of anode glass 80, between the glass flare 86 and the metal center section 70, used in known prior art designs, has been eliminated. It is noted that it is more difficult and costly to form a glass to metal seal where the glass and metal parts intersect at an angle. In a preferred embodiment, the angle of flared glass portion 486 is 39° relative to tube axis 40. This is a substantially smaller angle than is used in typical prior art designs. Housing glass shield 410 is redesigned to have the same shape as redesigned anode glass 480. Thus, the angle of the flare on glass shield 410 is also 39°.

Also in accordance with the present invention, a ground plane screen 415, contained within the housing (not shown), is utilized to define a ground equipotential adjacent to the anode glass 480. Ground plane screen 415, which is a metal structure having sufficient porosity to permit circulation of coolant through it, generally conforms to the shape of anode glass 480, having a cylindrical portion 417 and a conical or flared portion 418 interconnected by a curved portion 419. The benefit of using a ground plane screen is evident from FIG. 4. By defining a ground equipotential boundary which conforms to the shape of the anode glass, the ground plane screen assists in attaining parallelism of the electric field lines in the vicinity of the curved glass portion 483.

Rotor 450 also has a flared surface 455 which is designed to match the shape of the anode glass in the vicinity of the curved portion 483. This further assists in shaping the electric field gradient so that the equipotential lines are more nearly parallel to the inner surface of the anode glass. In particular, rotor flare surface 455 defines an anode voltage equipotential parallelling the surface of curved glass portion 483.

Although, an improved metal center tube has been described having three distinct elements to modify and improve the electric field gradient in the vicinity of the critical region of the anode glass, it is not necessary that all three improvements be utilized to obtain the benefits of the present invention. In some instances, only one or two of the elements may be used to obtain superior performance. For example, the number of modifications made may depend on the power level of the tube.

Although the present invention has been described in detail with reference to the embodiments shown in the drawings, it is not intended that the invention be restricted to such embodiments. It will be apparent to those skilled in the art that various modifications and departures from the foregoing description and drawings may be made without departing from the scope or spirit of the invention. Therefore, it is intended that the invention be limited only by the following claims.

What is claimed is:

1. A rotating anode x-ray tube comprising:

a cathode, means for electrically connecting said cathode to the exterior of the x-ray tube at a cathode end of said x-ray tube;

an anode adapted to be rotated about a central axis of the tube, said anode being held at a first potential;

means for electrically connecting said anode to the exterior of the x-ray tube at an anode end generally opposite said cathode end;

a vacuum envelope containing said cathode and said anode, comprising a metal section held at a second potential that is substantially more negative than said first potential such that an electric field gradient is formed between said anode and said metal center section, and an anode glass section between said metal section and said anode end, said anode glass vacuum envelope section having a flare portion, a cylindrical portion and a curved portion between said flare portion and said cylindrical portion; and, means for preventing the accumulation of electrons on the inner surface of the curved portion of said anode glass envelope section.

2. The x-ray tube of claim 1 wherein said means for preventing the accumulation of electrons comprises means for causing the electric field lines to parallel the surface of said flare portion of said anode glass.

3. The x-ray tube of claim 1 wherein said flare portion of said anode glass is sealed directly to said metal portion of said tube vacuum envelope, such that said seal is at an acute angle in respect to said axis of rotation.

4. The x-ray tube of claim I further comprising a housing for containing said x-ray tube, said housing containing a metal screen adjacent to said anode glass, said metal screen being held at said second potential.

5. The x-ray tube of claim 1 further comprising a rotor connected to said anode, said rotor comprising a curved portion adjacent to and generally conforming to said curved portion of said anode glass.

* * * * *